US007506829B2

(12) United States Patent
Tribuzio et al.

(10) Patent No.: US 7,506,829 B2
(45) Date of Patent: Mar. 24, 2009

(54) PROCESS FOR THE PRODUCTION OF WHEAT FLOUR

(76) Inventors: Giovanni Tribuzio, Via Telesforo, 31, I-71100 Foggia (IT); Alberto Lodi, Via Bellini, 48, I-43023 Monticelli (Parma) (IT); Angelo Gottofredi, Via Guareschi, 18/a, I-43036 Fidenza (Parma) (IT); Roberto Ranieri, Via Sanguigna, 130, I-43052 Colorno (Parma) (IT)

( * ) Notice: Subject to any disclaimer, the term of this patent is extended or adjusted under 35 U.S.C. 154(b) by 566 days.

(21) Appl. No.: 10/529,728

(22) PCT Filed: Sep. 29, 2003

(86) PCT No.: PCT/EP03/10804

§ 371 (c)(1),
(2), (4) Date: Oct. 19, 2005

(87) PCT Pub. No.: WO2004/028694

PCT Pub. Date: Apr. 8, 2004

(65) Prior Publication Data

US 2006/0257541 A1 Nov. 16, 2006

(30) Foreign Application Priority Data

Sep. 30, 2002 (IT) ..... MI02A2066

(51) Int. Cl.
*B02B 5/00* (2006.01)
*B02C 7/18* (2006.01)
*B02C 11/00* (2006.01)

(52) U.S. Cl. ..... 241/7; 241/11

(58) Field of Classification Search ..... 241/6, 241/7, 11

See application file for complete search history.

(56) References Cited

U.S. PATENT DOCUMENTS

| | | | | |
|---|---|---|---|---|
| 3,399,839 | A | | 9/1968 | Anderson et al. |
| 4,126,707 | A | * | 11/1978 | Hart ..... 426/462 |
| 4,189,503 | A | | 2/1980 | Giguere |
| 4,329,371 | A | * | 5/1982 | Hart ..... 426/461 |
| 4,986,997 | A | * | 1/1991 | Posner et al. ..... 426/622 |
| 5,115,984 | A | * | 5/1992 | Satake ..... 241/7 |
| 5,186,968 | A | * | 2/1993 | Wellman ..... 426/483 |
| 5,271,570 | A | * | 12/1993 | Satake et al. ..... 241/7 |
| 5,505,974 | A | * | 4/1996 | Rogers ..... 426/473 |
| 5,586,492 | A | | 12/1996 | Graef |

* cited by examiner

*Primary Examiner*—Bena Miller
(74) *Attorney, Agent, or Firm*—McDermott Will & Emery LLP

(57) ABSTRACT

A process for the production of wheat flour or semolina, comprising the steps of a) wetting the caryopses of wheat with such and amount of water as to bring their moisture content to at least 15%, subjecting them to intense vibrations; b) subjecting the wet caryopses to a conditioning step; c) subjecting the conditioned caryopses to operations of decortication, to take off the outer layers of bran; d) milling the conditioned and decorticated caryopses.

4 Claims, No Drawings

PROCESS FOR THE PRODUCTION OF WHEAT FLOUR

The present invention relates to the foodstuff industry.

In particular it relates to a process for the production of wheat flour and especially semolina from durum wheat (*Triticum turgidum* var. durum, Desf.).

As is known, flour and semolina, respectively from soft wheat (*Triticum aestivum,* L.) and durum wheat, are obtained by grinding the caryopses and subsequently removing the bran.

Taking durum wheat as example, the caryopses have a central nucleus consisting of endosperm, a germ, and a coating of various layers constituting the bran and representing about 15% by weight of the caryopsis itself.

The traditional process for the production of flour or semolina foresees a plurality of conditioning phases (3-4) of the caryopses with water and/or steam for 8-12 hours, with the purpose of giving uniformity to and optimising the moisture of the endosperm and at the same time facilitating the separation of the bran. This is followed by milling (breaking, sifting) done by machines provided for that purpose.

The finest fractions, consisting mainly of endosperm, together with bran and germ, and separated out by sifting are sent on to successive purification phase.

The coarser fraction, consisting mainly of bran but also of endosperm, is sent to a further milling phase to recover the endosperm.

This can be repeated many times, each time producing fine bran and germ particles that are difficult to separate from the endosperm.

This way the final yield of semolina is penalised, as is the quality of the obtained semolina.

Patent EP 0 598 022 describes a procedure for the wetting of cereal grain that utilises a machine capable of generating vibrations and that leads to a substantial reduction of the time of the single successive conditioning step, with a positive effect on the overall time of the production process.

In patent application EP 0 295 774 there is proposed, for the production of wheat flour, an alternative process that mills the caryopses after the selective removal of the various layers constituting the bran.

More precisely, the process according to the aforesaid application provides for the steps of 1) treating the caryopses with a quantity of water sufficient to condition the outer layers of bran but maintaining the endosperm essentially protected from the water;

2) subjecting the thus treated caryopses to friction operations to remove the outermost layers of bran and to successive operations of friction and abrasion to eliminate most of the remaining bran;

3) conditioning the caryopses with water in a conventional manner and grinding them.

In this way the quantity of bran produced in the milling step is slightly less and the number of crushing steps can be reduced, improving plant productivity.

According to the teaching of the abovementioned patent application, it is important that the initial conditioning step of the caryopses be carried out with an amount of water of less than 2% of the caryopses weight to avoid the different bran layers fusing together and those more internal remaining attached to the endosperm, making their separation from this last more difficult.

Nevertheless the Applicant has found experimentally that the process according to this document of the prior art is certainly appropriate for obtaining different bran layers in good purity through the operations of friction and abrasion described in the application but that it leads to serious inconveniences with regard to the subsequent milling phase, especially when working on the industrial scale.

Indeed, the conventional conditioning phase (with a water amount around 16% by weight of the caryopses weight), carried out on the caryopses stripped of most of their bran husk, gives rise to a packing of the caryopses, these tending to adhere one to the other, with consequent insurmountable technical difficulties in their handling and feeding into the milling machines.

The problem underlying the present invention has therefore been one of making available a process for the production of wheat flour or semolina, in particular the semolina of durum wheat, that permits improvement in the yield of the milling phase with the contemporary reduction of production times and the obtaining of a semolina that adheres perfectly to the severe qualitative regulations in force in Italy. All this avoiding the inconveniences indicated further above in relation to the process according to EP 0 295 774.

SUMMARY OF THE INVENTION

Such a problem is solved, according to the invention, by a process for the production of flour or semolina, from soft wheat or durum wheat respectively, starting from the relative caryopses as such, that includes the steps of a) wetting said caryopses with such a quantity of water to bring their moisture content to at least 15%, subjecting the caryopses to intense vibrations;

b) subjecting the wet caryopses to a conditioning step;

c) subjecting the conditioned caryopses to decortication operations, consisting essentially of an abrasion to remove the outer bran layers;

d) milling the conditioned and decorticated caryopses.

Preferably the caryopses undergo vibration at frequencies between 50 and 300 Hz, advantageously 75 Hz, generated by means of mechanical, electrical or magnetic energy or else by ultrasound.

Advantageously, the caryopses are exposed to vibration by means of a machine produced by the company Gräf GmbH & Co. KG, Lahnau, Germany, marketed by the name "Vibronet®.

The conditioning step carried out after the caryopses had been subjected to intense vibrations is only one and is advantageously faster with respect to the multiple (3-4) conditioning steps done conventionally, being limited to 4-6 hours instead of the total of 8-12 hours foreseen by traditional conditioning.

The process according to the present invention has the great advantage, with respect to that traditionally employed, that does not foresee the decortication of the caryopses before the milling step, to attain a 15-20% increase in the hourly throughput of one and the same mill. At the same time, it avoids the inconveniences tied to the presence of bran, like for example flooding and blocking due to variations in the volume of the bran as a function of its moisture content.

Moreover the lower amount of bran and germ in the caryopses undergoing milling leads to the production of a flour and semolina with an ash content within the norm even with a greater recovery of the finest fractions with high ash content, with evident advantages for what concerns the semolina and flour yield.

With respect to the process according to EP 0 295 774, the process of the present invention gives the marked advantage of avoiding the packing of the caryopses stripped of their bran husk, that occurs during the wetting and conditioning step of the above patent, and still allows easy decortication of the caryopses.

In fact, by using the process according to the invention, the fusion of the endosperm with the more internal bran layers complained of in the EP 0 295 774 application does not occur. According to a non-binding hypothesis, it is felt that this depends on the fact that the vibrations imparted to the caryopses during the wetting phase lower the surface tension of the bran layers and allow the water to penetrate rapidly to the central part of the caryopsis and become concentrated in the endosperm, leaving the bran layers relatively dry. In this way fusion between the endosperm and the innermost bran layers is avoided.

Furthermore it was found that the friction operations described in the application EP 0 295 774 can be omitted without in any way compromising the yield of the overall process or the quality of the final flour. The removal of the bran from the caryopses is therefore entrusted, according to the present process, solely to abrasion operations, with evident advantages in terms of plant simplification and reduction of processing times.

The process according to the present invention will be further described making reference to an example supplied here in the following as illustrative and not limiting.

EXAMPLE 115 kg of durum wheat previously cleaned conventionally had such a quantity of water added to it as to bring the moisture content of the caryopses to 16.5% and was, at the same time, exposed to vibratory stress imparted by a Vibronet® machine (vibratory pulses lasting about 10 seconds and with a frequency of 75 hz). After a single conditioning of 5 hours, the caryopses were fed to a first decortication or abrasion machine, comprising a rotating shaft with vertical axis supporting abrasive Carborundum wheels that peel away the outermost bran layers in the form of bran powder recovered by suction. The caryopses leaving the first decortication/abrasion machine underwent two successive steps in another two decortication machines that provided respectively for the elimination of the intermediate and internal bran layers, always in the form of bran powder. The three bran powders obtained at the outlet of the three decortication machines differ in fibre content, that was maximum in the first bran powder and minimum in the third, and in protein content, this, vice versa, being maximum in the third bran powder and minimum in the first The caryopses leaving the third decortication machine, of total weight about 100 kg corresponding to 87% of the initial weight, underwent air-stream dynamic cooling before being sent to a conventional mill for grinding. Here the decorticated caryopses were ground according to the operative modalities usually used for milling caryopses as such, obtaining at the end 85 kg of durum wheat semolina (74% yield) fully conforming to qualitative law requirements. In particular, the ash content was found to conform to the standards as did the particle size and the so-called speckling (in Italian: "puntatura") that, indeed, decreased in both its bran and black components with respect to that of semolina obtained using conventional processes.

Finally it is to be noted that a comparative test carried out on 100 kg of durum wheat from the same lot, subjected to conventional wetting and conditioning for 10 hours with such a quantity of water as to bring the moisture content of the wheat to 16.5%, and then ground without any prior decortication, in the same experimental and operative conditions as the above example, gave 70 kg of semolina, a yield equal to 70%.

As is noted on comparing the two tests, the process according to the invention supplies a higher yield than that of the conventional process. But there is another important advantage of the process according to the invention, and this consists of the possibility of notably increasing the plant milling capacity because the caryopses bear a very reduced bran residue amount and there is no further need to carry out any of the numerous passages (breaking) typical of the conventional milling process.

In the course of the operations on the industrial scale it was confirmed that the flow rate of the decorticated wheat fed to the mill was 15.20 t/h against a flow rate of 12.87 t/h found in the same mill when it was fed non-decorticated wheat.

Always operating on the industrial scale, the process according to the invention resulted in a 75.2% yield of semolina by weight of the initial durum wheat, whereas the maximum yield obtained with the conventional processes in one and the same mill was 70.1%.

The invention claimed is:

1. A process for the production of wheat flour or semolina starting from respective untreated caryopses, that includes the steps of a) wetting said caryopses with such a quantity of water as to bring their moisture content to at least 15%, by subjecting them to intense vibration;

b) subjecting the wet caryopses to a conditioning step, wherein said conditioning step has a duration of 4-6 hours;

c) subjecting the conditioned caryopses to decortication operations, consisting essentially of abrasion, to remove the bran;

d) grinding the conditioned and decorticated caryopses.

2. A process according to claim 1, in which the said wetting step is carried out while subjecting said caryopses to vibrations of a frequency between 50 and 300 Hz.

3. A process according to claim 2, in which said vibrations are generated by means of mechanical, electrical or magnetic energy or by ultrasound.

4. A process according to any one of the preceding claims, in which said untreated caryopses are caryopses of durum wheat.

* * * * *